US005865247A

United States Patent [19]

Paterson et al.

[11] Patent Number: 5,865,247

[45] Date of Patent: Feb. 2, 1999

[54] CELLULOSE INJECTION SYSTEM AND METHOD

[75] Inventors: Alexander J. Paterson, Rockland St. Mary, Great Britain; Alain Louis Loppinet, Bailly, France; Chafagat Fakhrazovitch Takhaoutdinov, vile d'Almetyevsk, Russian Federation; Anatoly Yossifovitch Lipert, ville d'Almetyevsk, Russian Federation; Serguey Anatolievitch Iakovlev, ville d'Almetyevsk, Russian Federation

[73] Assignees: Thermo Instrument Systems Limited; Tatolpetro, both of London, England

[21] Appl. No.: 640,801

[22] PCT Filed: Dec. 6, 1993

[86] PCT No.: PCT/GB93/02498

§ 371 Date: Nov. 18, 1996

§ 102(e) Date: Nov. 18, 1996

[87] PCT Pub. No.: WO95/16103

PCT Pub. Date: Jun. 15, 1995

[51] Int. Cl.[6] ..... E21B 43/20

[52] U.S. Cl. ..... 166/252.1; 166/53; 166/90.1; 166/275; 166/305.1

[58] Field of Search ..... 166/275, 305.1, 166/250.07, 250.1, 252.1, 53, 90.1

[56] References Cited

U.S. PATENT DOCUMENTS

| | | | |
|---|---|---|---|
| 3,707,191 | 12/1972 | Parker | 166/275 |
| 3,863,717 | 2/1975 | Cooper | 166/305.1 |
| 4,004,639 | 1/1977 | Sandiford | 166/292 |
| 4,014,527 | 3/1977 | Watson, Jr. | 259/151 |
| 4,374,544 | 2/1983 | Westerman et al. | 166/252 |
| 4,395,340 | 7/1983 | McLaughlin | 166/275 |
| 4,548,272 | 10/1985 | Norton et al. | 166/295 |
| 5,343,941 | 9/1994 | Raybon | 166/53 |

*Primary Examiner*—Hoang C. Dang
*Attorney, Agent, or Firm*—Olson & Hierl

[57] ABSTRACT

Improved techniques are provided for controlling the injection of a cellulose powder/water mixture input into a formation through an injection well for recovery of hydrocarbons. The initial dosing rate of powder added to the water is increased as a function of both the monitored pressure of the mixture in the wellbore in the vicinity of the formation, and the monitored flow rate of the injected mixture. The water flow rates and the flow dosing rates are optimised, and the mixture is controlled to obtain setting within the formation to enhance the recovery of hydrocarbons. A mixing tank is designed to prevent premature setting of the mixture. Portable equipment is provided for injecting the powder/water mixture into the formation, thereby increasing the versatility of the equipment reducing the overall costs of the recovery operation.

22 Claims, 6 Drawing Sheets

CELLULOSE INJECTION SYSTEM AND METHOD

FIELD OF THE INVENTION

The present invention relates to equipment and techniques for recovering oil from water invaded hydrocarbon fields, and more particularly, relates to improved water flooding techniques and equipment for increasing the efficiency of oil recovery operations.

BACKGROUND OF THE INVENTION

Water flood is a standard technique used to increase oil recovery from hydrocarbon fields. In a typical application, a plurality of injection wells at spaced locations in an older, somewhat depleted oil field are used to enhance the production of oil from production wells also spaced about the field. Pressurized water flows from an injection well through the permeable formation toward the relatively low pressure production well, which recovers oil with some water as the water flows through the formation toward the producing well. Those skilled in the art have long appreciated that while water flowing through the formation inherently carries some oil to the recovery well, water also tends over time to flow along the same well-established flow channels, which decreases the efficiency of the oil recovery operation. As a result of water flowing along these established flow channels, the water thus tends to entrain a smaller proportion of oil, so that the "water cut" of the produced fluids eventually exceeds the cost of separating the produced oil/water mixture into an economic hydrocarbon-based product.

To improve the recovery of oil using water flooding techniques, those skilled in the art have recognized the benefit of blocking established water channels through the formation to force the injected water to find new channels and thereby entrain new oil which is recovered with the water. U.S. Pat. No. 4,194,563 discloses a technique for improving water flooding operations by injecting a course emulsion into flow channels in the formation, then washing the wellbore with alcohol to remove the emulsion formed adjacent the wellbore. U.S. Pat. No. 4,529,523 teaches a method of enhancing water flooding by using a hydroxyethyl cellulose to prevent fingering of water through existing flow channels in the formation. U.S. Pat. No. 4,903,768 teaches a technique for controlling the profile of an oil/water interface in a high permeability zone, with either water flooding or carbon dioxide stimulation being used as the driving process. A breakthrough is shut-in using a temperature activated mixture which forms a solid blocking gel.

Those skilled in the art of water flooding also appreciate that an oil/water emulsion may be used to plug or at least reduce flow in a highly porous zone, thereby preventing undesirable water fingering and improving the flow of hydrocarbons to a recovery well. U.S. Pat. No. 3,472,319 teaches a technique for mixing an oil-in-water emulsion with a minimum of shear energy. The mixture is injected into the formation as a low viscosity emulsion, so that the oil droplets swell in the formation to plug or partially plug existing water channels. U.S. Pat. No. 3,724,546 teaches using a blood/water mixture for a water flooding operation. While various products have been used for injection with the water to assist in the water flooding operation by blocking or partially blocking the established flow channels, cellulose is a preferred injection product for many water flooding applications. The use of cellulose as a mixing material with the injection water is according well known, as evidenced by U.S. Pat. Nos. 3,848,673, 4,321,968, 4,451,389, 4,627,494, 4,629,575, and 5,100,567. The concentration of cellulose which is injected with the water into the formation may be varied. By optimising the fluid injection rates, the recovery of hydrocarbons can be increased during the secondary or tertiary recovery processes. U.S. Pat. No. 4,374,544 and European Publication 48 342 disclose techniques for optimising injection rates while also preventing fracturing of the formation, which may reduce the effectiveness of the oil recovery process.

Those skilled in the art of secondary and tertiary recovery of oil have generally recognized the benefits of trailer mounted mixing and injection devices, such as those disclosed in an article entitled "Enhanced Recovery Requires Special Equipment", Oil and Gas Journal, Jul. 12, 1976, pp. 50–56. U.S. Pat. No. 4,448,535 discloses portable apparatus for blending sands and solid additives at selected rates for injection with water into a well. A dry chemical is preferably fed into a mixing tank adjacent a variable venture nozzle, where the water is at a low pressure and is in high shear. European Patent Application No. 91309842.2 teaches a technique for mixing a solid and a fluid continuously to facilitate a gravel packing operation. A solids hopper with an internal auger is used to monitor the solids flow rate, with liquid being directed into the mixing chamber around the periphery of the auger. U.S. Pat. No. 4,311,395 discloses a chassis arrangement for mounting equipment used in well servicing operations. U.S. Pat. No. 4,077,428 teaches a transportable water injection plant for a water flooding operation. U.S. Pat. No. 4,534,869 teaches a portable filtration system with a three stage filtering process useful for a fracking operation. U.S. Pat. No. 4,597,437 discloses a portable plumbing and production assembly for use in hydrocarbon operations.

U.S. Pat. No. 4,518,261 discloses a process for dissolving a polyacrylamide powder in an aqueous solution for enhanced oil recovery. In order to prevent moisture build up and caking of the powder, a nitrogen blanket may be used. Polymers mixed with injection water in a flooding process may be transported to a mixer with dry air, as disclosed in U.S. Pat. No. 4,014,527. Systems for controlling the injection of a gel-type fluid into a well are disclosed in U.S. Pat. Nos. 3,707,191, 4,265,266, and 4,953,618. Equipment for mixing a dry material with water are disclosed in U.S. Pat. Nos. 3,902,558, 4,357,953, 4,725,379, and 5,190,374.

Although a great deal of effort has thus been expended to improve the recovery of oil using water flooding techniques, further improvements in this technology and associated reductions in the cost of recovery operations are essential if partially depleted hydrocarbon fields are to supply an increasing role in meeting future oil needs. Huge quantities of proven low pressure oil reserves exist in many parts of the world, and versatile equipment and improved techniques are required to economically recover those reserves.

The disadvantages of the prior art are overcome by the present invention, and improved oil recovery equipment and techniques are hereinafter disclosed for more efficiently recovering oil from depleted fields.

SUMMARY OF THE INVENTION

According to the present invention, a cellulose powder is mixed with water and the mixture injected downhole into the formation. The cellulose powder hydrates with the water approximately thirty minutes after mixing, when the water is preferably within the formation, to form a highly viscous mixture which blocks old water channels, thereby forcing the injected water to find new channels through the formation and thereby entraining more oil which is carried toward the production wells. The cellulose powder and the injection water are mixed in a low viscosity vortex mixing chamber which is trailer mounted to facilitate transportation to various well sites. A nitrogen blanket is preferably used to prevent moisture build up and exclude the entry of oxygen into the system, which may damage the oil recovery operations, or adversely affect the formation or the formation fluids.

The technique of this invention may be used to accurately control the injection of a cellulose powder, such as hydroxyethylcellulose, into a formation to enhance oil recovery. The cellulose powder may be mixed with available injection well water, and the mixture pumped through various injection wells into the porous formations to efficiently block the well-established or existing flow channels. Computer software allows the system to be easily adapted to specific well and formation conditions. The accurate control of the proportion of the hydroxyethylcellulose mixed with the injection well water is regulated to optimise the resistance to water flow through the porous formation, thereby minimizing short-circuiting of water from the injection well to the recovery well and accordingly increasing the efficiency of the oil recovery operation.

The present invention uses special equipment and techniques to determine the proper flowrate and the proper cellulose dosage for maximising the desired blocking effect on established water channels. A control system according to the present invention is provided for receiving operator input and for determining an adequate flowrate and the desired concentration of cellulose for injection with the predetermined water flowrate. Annulus and tubing head pressure at the water injection well are monitored. The flowrate is increased from the minimum flowrate to the maximum allowed by the pumping equipment, and tubing head pressure is monitored to allow the choice of the correct flowrate according to the ability of the well to dissipate the mixture. The cellulose injection rate is increased and/or decreased until the maximum permissible annulus and tubing head pressure is reached but not exceeded. Changing the cellulose injection rates thus varies the viscosity of the water/cellulose mixture downhole, and thus desirably creates the plugging effect on existing water channels. The technique of this invention thus increases the accuracy of the dosage rate for the cellulose powder, and allows full monitoring and recording for each injection. Polymers other than cellulose may also be mixed with water to form the mixture to be pumped downhole. Any additive could be injected into the cellulose/water mixture by a chemical injection pump after mixing and before the pumps.

In a suitable embodiment, the improved equipment used for performing the operation comprises four transportable modules each interlinked through local and centralized control systems: 1) a pumping/injection trailer; 2) a cellulose mixing and control trailer; 3) a power generation/utilities trailer; and 4) a bulk powder tanker. Injection fluid pressure, temperature, and flowrate measurements may be taken with suitable monitoring equipment, and signals from this equipment may be linked through a remote terminal unit to a supervisory/control computer. The system may be capable of operating at surface temperatures of from −40° C. to +40° C., thereby enhancing its versatility.

It is an object of this invention to provide improved techniques for monitoring various injections conditions, such as injection well pressure, injection fluid flowrates, and injection water inlet temperature, and in response to these conditions, adjusting the flow and dosage rate of the powder which will cause optimum downhole blocking of the well established flow channels to increase the efficiency of the recovery operation.

Another object of this invention is obtained by providing versatile equipment which can be effectively used at various oil field sites to more efficiently recover hydrocarbons.

Still another object of this invention is to provide improved techniques and equipment which can more efficiently recover hydrocarbons from somewhat depleted oil fields, thereby making possible the economical recovery of hydrocarbons which are not being recovered by existing technology.

It is a feature of this invention that the techniques for adjusting the powder dosage rate, as well as any combination of dosing rate and flowrate, may be automatically controlled to easily and inexpensively achieve a more optimum injection rate.

Yet another feature of this invention is that the equipment for performing the improved water flooding techniques may be portable, thereby increasing the versatility of the equipment. Most of the system components have been individually used and tested in previous oil recovery operations, so that the reliability of the system is high and the equipment cost is comparatively low.

The advantage of the present invention is that the technique for determining the correct dosage rate is well suited for various powder polymer materials which serve to block the well-established flow channels when injected with water into a formation. The dosage technique of the present invention is particularly well suited for use with a cellulose material, which is widely used as an addition for mixing with water to perform a water flooding technique.

Another advantage of the invention is that the equipment is capable of reliable operation over a wide range of ambient temperatures, and is particularly adapted for use in oil fields having relatively cold ambient temperatures.

A further advantage of the invention is that the technique used may also optimise the injection by combining flowrate and dosage rate parameters in order to obtain the best injection mixture conditions for a particular injection well.

Thus according to the present invention there is provided a method of controlling the injection of a powder/water mixture through an injection well and into a formation for recovery of hydrocarbons, the method comprising:

(a) determining a desired mixture injection flow rate;

(b) selecting an initial dosage rate of powder;

(c) mixing the selected initial dosage rate of powder and water to form an initial powder/water mixture ration;

(d) injecting the powder/water mixture through the injection well and into the formation:

(e) monitoring the pressure of the powder/water mixture in the well bore in the vicinity of the formation during step (d);

(f) increasing the selected initial dosage rate of powder to increase the powder/water mixture ratio;

(g) determining a high dosage rate of powder obtained when the monitored pressure reaches a predetermined limit; and (h) thereafter setting the dosage rate between the initial dosing rate and the high dosage rate for injecting the mixture into the formation.

According to a second aspect of the invention there is provided a system for controlling the injection of a powder/ water mixture through an injection well and into a formation for recovery of hydrocarbons, the system comprising:

a mixing tank for mixing a selected initial dosage rate of powder with water to form an initial powder/water mixture ratio;

a pressure sensor for monitoring the pressure of the mixture in the well bore;

fluid control means for maintaining a desired flowrate of the mixture into the injection well;

a flowmeter for monitoring the flowrate of the mixture injected into the injection well; and dosage control means for automatically increasing the selected initial dosage rate of powder at a rate functionally related to the monitored pressure and the monitored flow rate.

According to a third aspect or the invention there is provided a system for controlling the injection of a powder/water mixture through an injection well and into a formation for recovery of hydrocarbons, the system comprising:

a portable tanker for storage of cellulose powder;

a portable hopper for housing cellulose powder;

a portable compressed air source for transporting the cellulose powder from the tanker to the hopper;

a portable mixing tank for mixing a selected initial dosage rate of powder with water to form an initial powder/water mixture ratio;

a portable conveyor for conveying the cellulose powder from the hopper to the mixing tank;

a pressure sensor for monitoring the pressure of the mixture in the well bore;

a flowmeter for monitoring the flowrate of the mixture injected into the injection well; and dosage control means for automatically increasing the selected initial dosage rate of powder at a rate functionally related to the monitored pressure and the monitored flowrate, the control means including means for adjusting the flowrate of cellulose powder along the conveyor.

According to a further aspect of the invention there is provided a method of recovering oil from a hydrocarbon field, which method includes delivering a mixture of a gel-forming material and water downhole so that the gel-forming material hydrates to form a viscous gel after delivery, and which method further comprises monitoring the back-pressure of the mixture and varying in response thereto the concentration of the gel-forming material in the mixture to vary the viscosity of the gel downhole.

DETAILED DESCRIPTION OF A PREFERRED EMBODIMENT

Figure 1:
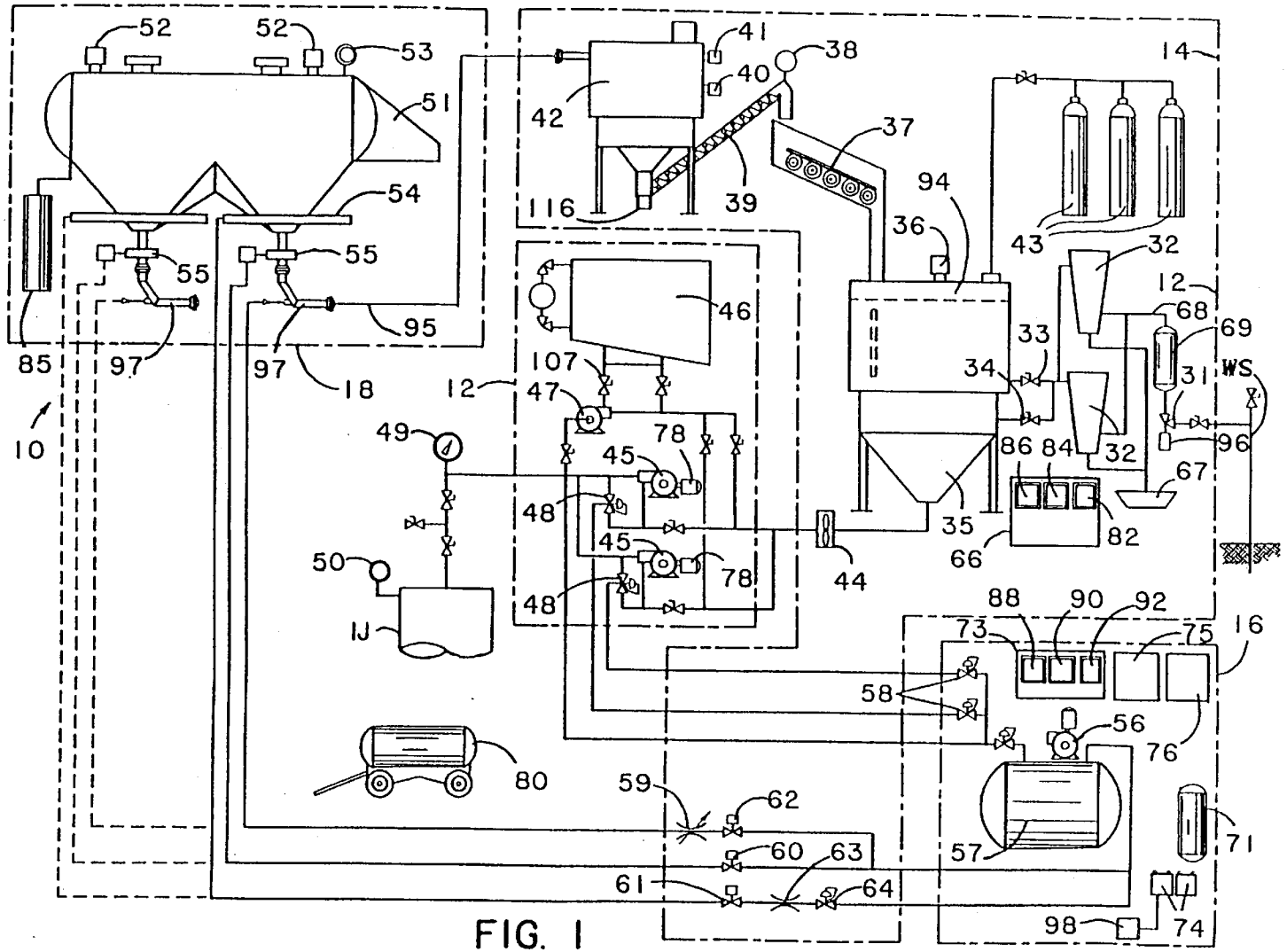
FIG. 1 is a schematic representation of portable equipment according to the present invention for receiving water from a supply line, for adding the desired amount of cellulose powder to the water, and for injecting the powder/water mixture into an injection well for a water flooding operation.

FIG. 1 schematically illustrates one embodiment of an equipment assembly according to the present invention for performing a water flooding operation to recover oil from a partially depleted, low pressure production field. The assembly 10 is portable, so that the equipment may be easily transported from one injection well to another, and/or from a production field to another, thereby reducing overall equipment costs. The primary components of the assembly 10 are mounted on one of four trailers: a pumping/utilities trailer 12, a cellulose mixing and control trailer 14, a power generator/utilities trailer 16, and a bulk trailer 18. Each trailer may be a conventional transport trailer which accordingly may be easily positioned at a desired location about the production field. The water flooding operation utilises an available water source, which may be output from a site water supply WS pipeline. The assembly 10 mixes the water with a cellulose powder, and injects the mixture down one of a plurality of selectively positioned injection wells U, so that more oil may be recovered from the production field. Depending on the particular type of water flooding technique utilised, oil may be simultaneously recovered from one or more of a plurality of production wells (not shown) spaced about the field.

Recovered water from supply WS (production water, waste water, river water or a mixture of one or more of these water supply sources) may be pressurized by suitable equipment not depicted in FIG. 1. Pressurized water used for injection is first pressure-regulated by choke valve 31, which is automatically responsive to the level control device 36 provided on mixing tank 35 to maintain the desired water level in the mixing tank. Before being passed to tank 35, the water preferably is filtered to reduce equipment wear and damage to the formation, and suitable hydrocyclone filters 32 are thus provided between the choke valve 31 and the mixing tank 35. Waste skip 67 may also be provided on trailer 14 for storage of the discharge from the filters 32. A high delivery control valve 33 and a low delivery control valve 34 are provided in parallel between the filters 32 and the tank 35, and the operator may control each valve as a function of the desired injection water flowrate to create a vortex in the mixing tank 35. The operator therefore determines a desired injection flowrate into an injection well utilizing conventional techniques, and then regulates the control valves to achieve that desired flowrate. Since the quantity of dosing material added is relatively small, the desired or optional injection flowrate is, for practical purposes, the desired or optimal water flowrate to the mixing tank.

The cellulose/water mixture from the mixing tank 35 passes through flowmeter 44, and then to pumping trailer 12, where the mixture is pressurized to a selected pressure by one or two injection pumps 45 mounted in parallel on the trailer 12. The mixture is then transmitted through a series of conventional valves to a selected injection well 13 as shown in FIG. 1. The mixture is injected into the formation and is pushed in the direction of the production wells with the injected water serving to entrain the oil in the formation and carry it toward the production wells. According to this invention, the cellulose is dispersed in the water at a desired rate within the mixing tank 35, but hydration is delayed due to the mixing process. Each injection pump 45 is driven by a variable speed motor 78 so that the desired injection flowrate for an individual well may be achieved by controlling the speed of the pumps 45. Each of the main pumps 45 may thus be powered by a double wound motor 78, so that each pump may operate at two different pump speeds. Alternatively, each pump 45 may operate at a continuously variable speed if a variable speed drive motor is utilised.

The bulk trailer 18 includes a conventional tanker 51 for housing cellulose powder. Compressed air from the generator trailer 16 pressurizes the tanker 51 to a desired pressure level, e.g., slightly greater than ambient pressure. Transmitters 52 may be provided for monitoring the level of powder within the tanker 51. The pressure regulator 64 and a flow control orifice or flow choke 63 on the trailer 14 may thus be adjusted to set the air pressure in the tanker 51 at a desired level. The fluid pressure within the tanker may be monitored by pressure transmitter 53. Nitrogen bottles 85 may be provided on the bulk trailer 18 for subjecting the powder in the tanker 51 to inert gas when the powder is not being delivered to the hopper 42. In response to a signal from the powder hopper 42, one of the product valves 55 is opened to deliver powder from the tanker 51 through the flexible line 95 to the feed hopper 42.

Blowdown control valves 59 and 62 may be used to adjust the pressure in the flexible line 95. Flow control of the regulated air may also be set by a suitable nozzle 97 to provide a consistent blow of air pressure higher than that present in the tanker 51. Fluidizing pads 54 on the tanker 51 keep fine powder flowing to the production valves 55. During start-up, or if the flow line to the hopper 42 should become plugged, production valves 55 may be closed and only pressurized air blown down the transfer line 95. When the level of powder in the hopper 42 drops below the low level switch 40, the powder control valves 60 and 61 are opened to start the air flow down the transfer line 95. After predetermined period of time. e.g., two seconds, product valves 55 are opened. Powder is then supplied to the hopper 42 until the high level switch 41 is covered with powder, (or alternatively after a preselected time period has expired), at which time the product valves 55 are closed and the transfer line 95 cleaned with pressurized air.

The desired dosage rate of powder is supplied to the tank 35 from the hopper 42 by the screw conveyor 39 and the vibrating table 37 simplistically shown in FIG. 1. The variable speed screw conveyor 39 is calibrated for supplying powder to the mixing tank at a desired dosing rate. The mixing tank 35 includes two angled water inlets, with each inlet being in fluid communication with one of the valves 33 and 34 to create a vortex within the mixing tank. Either or both of the valves 33 and 34 may be opened by the operator, depending on desired water flowrate to the mixing tank and thus to the injection well. Cellulose powder from the vibrating table 37 may be added to the center of the vortex to ensure that the powder is evenly mixed with the water. The powder remains for a substantially uniform and short duration time within the mixing tank 35 before being discharged to the pumps 45.

A control panel 66 on the trailer 14 includes a primary or supervisory/control computer 82, a personal computer 84 with a data entry keyboard, and an audible or visual alarm 86. Computer 82 receives a flowrate signal from the flowmeter 44, and transmits a powder flowrate signal to the variable speed screw conveyor 39 to supply powder to the mixing tank 35 at the desired dosage rate. The desired dosage rate signal may be expressed as a function of a dosing percentage rate multiplied by the flowrate signal from the flowmeter 44, then divided by a constant that is derived from the calibration for the particular product in use, to yield the powder flowrate signal which controls the revolutions of the conveyor 39 to supply the desired quantity of powder to be mixed with the injection water. A tacho feedback loop 38 is provided to ensure that the correct conveyor speed is achieved. The computer 82 and the tacho 38 thus regulate the rare that powder added to the injection water, and monitor the powder addition rate and the actual conveyor speed to provide the proper dosage rate. The air space 94 above the water in the mixing tank 35 is preferably pressurized with nitrogen or another inert gas to ensure that moisture is suppressed from rising, since the premature combination of moisture and the powder adversely affect the operation of the system. A nitrogen blanket in the space 94 also ensures that oxygen is not entrained in the injection water/powder mixture, thereby minimizing corrosion of the tubular strings in the injection well and production wells, as well as damage to the formation and formation fluids. Nitrogen may be supplied to the tank 35 from bottles 43 mounted on the trailer 14. The water level in the mixing tank 35 is thus regulated by choke valve 31, which in turn is controlled by a dedicated choke valve controller 96. As explained subsequently, controller 96 receives a signal from the mixing tank level transmitter 36, and compares the transmitter signal with a requested mixing tank level signal input to the controller by the computer 82.

Two diesel generators 75 and 76 are mounted on the trailer 16 for generating electrical power, with each generator being fueled by diesel tank 71. A diesel transport unit 80 is provided for intermittently filling the tank 71. In a suitable example, the generator 75 may be a 15 kilowatt air-cooled generator for supplying single phase 220 volt A.C. power, while the generator 76 is a 395 kilowatt water-cooled generator for supplying both three phase 380 volt and single phase 220 volt power. The generator 76 temperature should be above −10° C. before it is started, and accordingly the generator 75 may be initially started at a colder temperature, and the power from the generator 75 used to heat the oil sump of generator 76 before the generator 76 is started. Those, skilled in the art will appreciate that generators 75 and 76 may not be necessary if the production field is located where another power supply, such as a 380 volt AC supply, is available. Generator control panel 73 is mounted on the trailer 16, and includes a computer 88, pump controls 90, and motor controls 92.

Generators 75 and 76 thus supply electrical power to emergency batteries 74, which also serve as a D.C. power supply. The pump motors 78, and other motors (not shown) which may be provided on any one of the trailers, are thus powered by the generators. A transformer 98 may be used to charge emergency batteries 74. Three phase, 380 volt power is thus available for driving the motors 78, and the motor (not shown) which powers the air compressor 56 which pressurizes receiver or tank 57. Single phase, 220 volt power may be used for pump control logic for driving the motors for the screw conveyor 39, and for powering a D.C. power supply or batteries 74. Power from the 24 volt D.C. supply may be used for logic control, and for powering the computers. Although not shown in FIG. 1, those skilled in the art will understand that the generator trailer 16 may also include conventional power and engine monitoring equipment, as well as automatic shut-down equipment.

Water flushing tank 46 provided on the pumping trailer provides a water supply source in case of loss of the supply from the anticipated water source, and provides water for clean-down of the injection well and for clean down of the equipment before relocation of the equipment. Flush pump 47 is controlled by the offload control valves 107 on the trailer 12. To reduce the power required to start the pumps 45, an automatic off-loading system is also provided. The equipment shown in FIG. 1 is designed to reduce the likelihood of powder mixing with water prior to being intentionally mixed in the mixing tank 35, so that mixture will set at its desired location within the porous formation, and will not set prematurely. The assembly as shown in FIG. 1 is, however, also constructed for quick disassembly, so that blockages caused by premature setting may be easily cleared and the system properly maintained.

Figure 2:
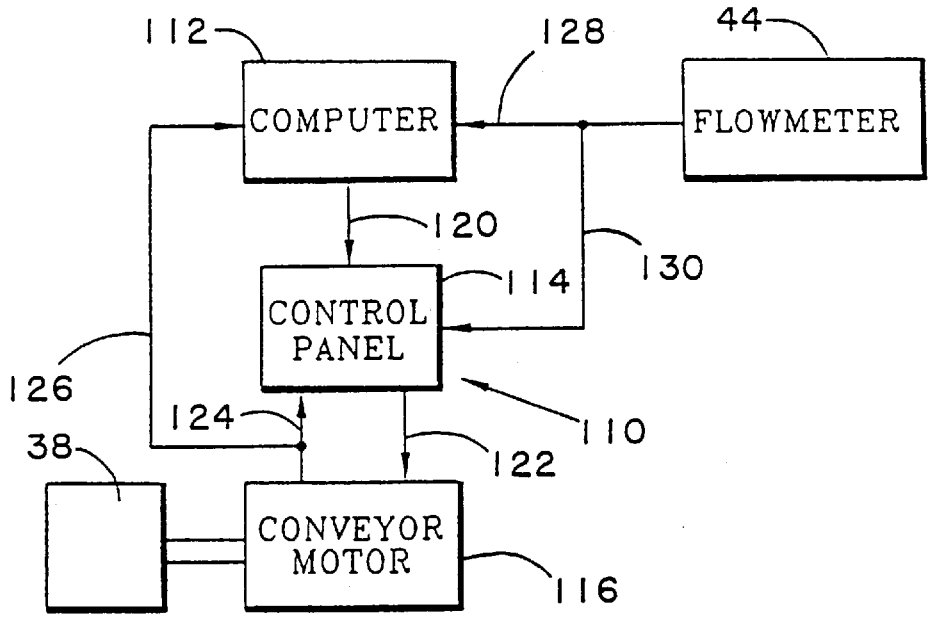
FIG. 2 is a block diagram of suitable control logic for regulating the screw conveyor generally shown in FIG. 1.

FIG. 2 illustrates suitable control logic 110 for regulating the speed of motor 116 which drives the conveyor 39 shown in FIG. 1. The control panel 114 schematically illustrated in FIG. 2 may be the personal computer 84 (depicted in FIG. 1, and the computer 112 similarly illustrated in FIG. 2 may be the computer 82 shown in FIG. 1. The computer 112 generates a desired dosage signal, Qhr, which is transmitted as signal 120 to the control panel 114. Flowmeter 44 thus generates a flowrate signal, Q, which is shown in FIG. 2 as 128, which signal is input to the computer 112. The same flowrate signal Q is also input as signal 130 to the control panel 114. Control panel 114 generates the dosage signal 122 to the screw conveyor motor 116, with the signal 122 being a function of the Qhr signal 120 and the flowrate signal 130. The signal 122 thus serves to control the operation of the motor 116 at the desired speed. The screw conveyor tacho 38 in FIG. 1 generates a feed back loop signal 124 to the control panel 114 to ensure that the conveyor is operating at its proper speed. The speed or the conveyor motor 116 is also input as signal 126 to the computer 112 to serve as a check on the proper determination of the dosing rate. Computer 112 may activate an alarm (see 86 in FIG. 1) if the actual speed of the motor 116 does not correspond, within a selected range, to the desired dosage rate of powder to the mixing tank 35.

Figure 3:
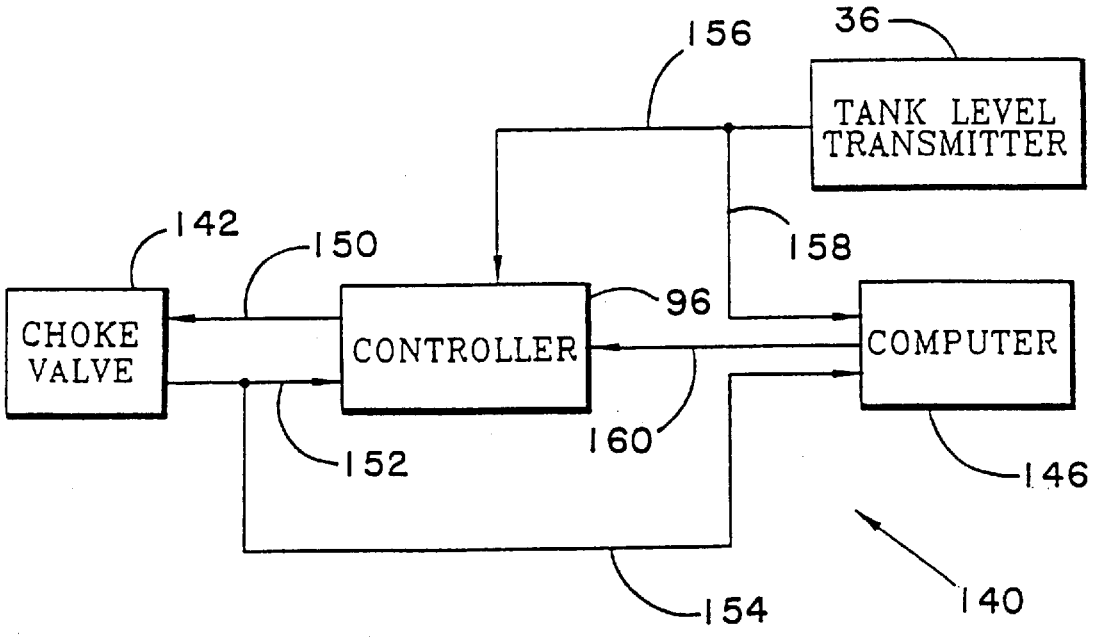
FIG. 3 is a block diagram of suitable control logic for regulating the choke valve generally shown in FIG. 1.

FIG. 3 illustrates suitable logic 140 for controlling the flow of water to the mixing tank 35. A tank level signal 156 is transmitted from the transmitter 36 to the choke valve controller 96, and a similar signal 158 is transmitted to computer 146, which functionally may be the computer 82 shown in FIG. 1. The controller 96 outputs a control signal 150 to the choke valve 31 to regulate the fluid flowrate to the mixing tank. The choke valve 31 includes a valve position indicator 142, which transmits a valve position signal 152 to the controller 96 to monitor the actual choke position and ensure that the valve is properly positioned by the controller. This same valve position signal may be transmitted as signal 154 to the computer 146, so that the computer 146 may compare the signals 158 and 154, and then generate a requested tank level signal 160 to the controller 96. Controller 96 receives signal 156 from the level transmitter 36 and compares this signal with the requested mixing tank level input signal 160 from the computer 146. The output signal 150 from the controller 96 is effectively transmitted as the choke position signal 154 back to the computer 146, so that computer 146 effectively receives both the tank level signal and the choke valve control signal to provide monitoring and alarm functions.

Figure 4:
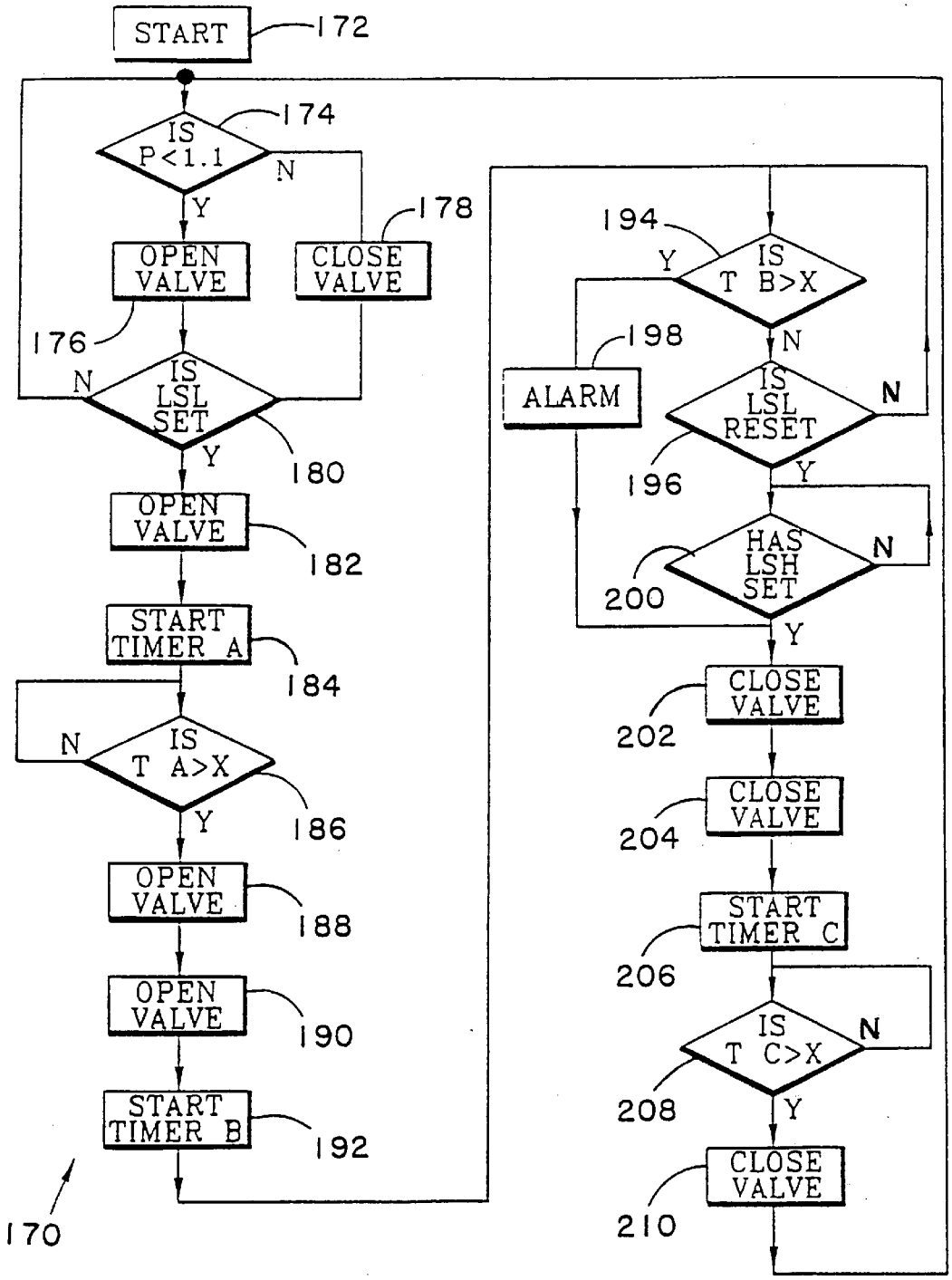
FIG. 4 is a block diagram of suitable logic for controlling the transfer of cellulose powder according to this invention.

FIG. 4 illustrates suitable control logic 170 for transferring powder from the tanker 51 to the hopper 42. The operation is initiated with at start step 172, and comparator 174 initially determines that the pressure P in the tanker is less than the preset value, which may be selected to be 1.1 Barg. If the tanker pressure is more than 1.1 Barg, step 174 first closes the tanker pressurization valve 61 as shown in FIG. 1 at step 178. If the tank pressure is less than the set 1.1 Barg value, operation step 176 opens the pressurization valve. Decision step 180 then determines if the low level switch 40 on the hopper 42 is sets and if set, the blowdown values 59 and 62 as shown in FIG. 1 are opened by step 182. Step 184 starts timer A, and comparator 186 determines if timer A exceeds a selected value, X, which selected value representatively may be 2 seconds. Once the time is greater than 2 seconds, the tanker pressurization valve 61 and the product valve 55 are opened by steps 188 and 190, respectively. A second timer B may then be started by step 192, and comparator 194 used to determine if the time set by timer B is greater than a selected number of seconds, X, if the time is greater than X, an alarm is sounded by step 198. Assuming, however, that the time is less than X, decision step 196 determines if the switch 40 has been reset. Assuming the switch 40 has been reset, decision step 200 determines if the high level switch 41 has been set. Once that product control valve 55 is closed by step 202, then the tanker pressurization valve 61 is closed by sites 204. Step 206 starts a third timer C, and comparator 208 determines if time is greater than a selected time, X. Assuming the proper time has transpired, blowdown line values 59 and 62 are closed by step 210.

Figure 5:
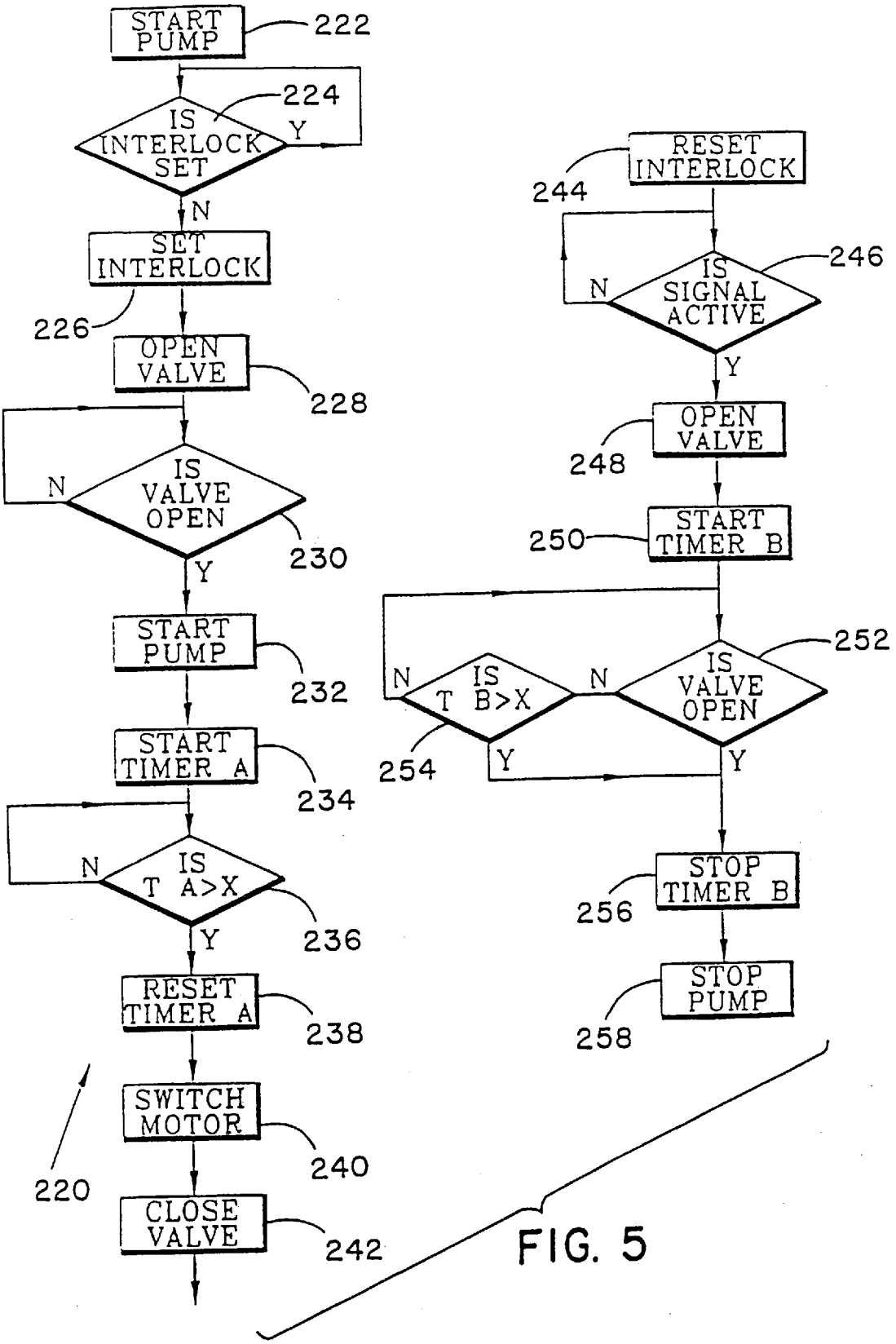
FIG. 5 is a block diagram of suitable logic for operating the injection pumps generally shown in FIG. 1.

A suitable logic diagram 220 for controlling the injection pumps 45 is depicted in FIG. 5. Step 222 generates a start pump request signal, and decision step 224 determines if the interlock flag is properly set. If the interlock flag is not set, step 226 sets the interlock flag. Step 228 opens the air valves 58 which will supply air to open the offloading valves 48. Decision step 130 determines that the offloading valves have been properly opened, then step 232 starts one of the pumps 45 in the star configuration, with timer A then starting as shown in step 234. Comparator 236 determines that time is above a selected value, X. Once time is greater than X, step 238 stops and resets the timer A. Operation step 240 switches the motor 45 to the delta configuration, and the offloading valves are closed by step 242. The interlock flag is reset by step 244. Decision step 246 checks that the stop pump request signal is not active. When the request signal is activated, step 248 opens the off loading valve and another timer B is started by step 250. Assuming the request signal is active, step 248 opens the offloading valves, and another timer B is started by step 250. Step 252 ensures that the offloading valves are opened and, if not opened, comparator 254 determines whether the elapsed time is greater than X. Step 256 stops and resets the timer B, and the pumps 45 are stopped by step 258.

Figure 6:
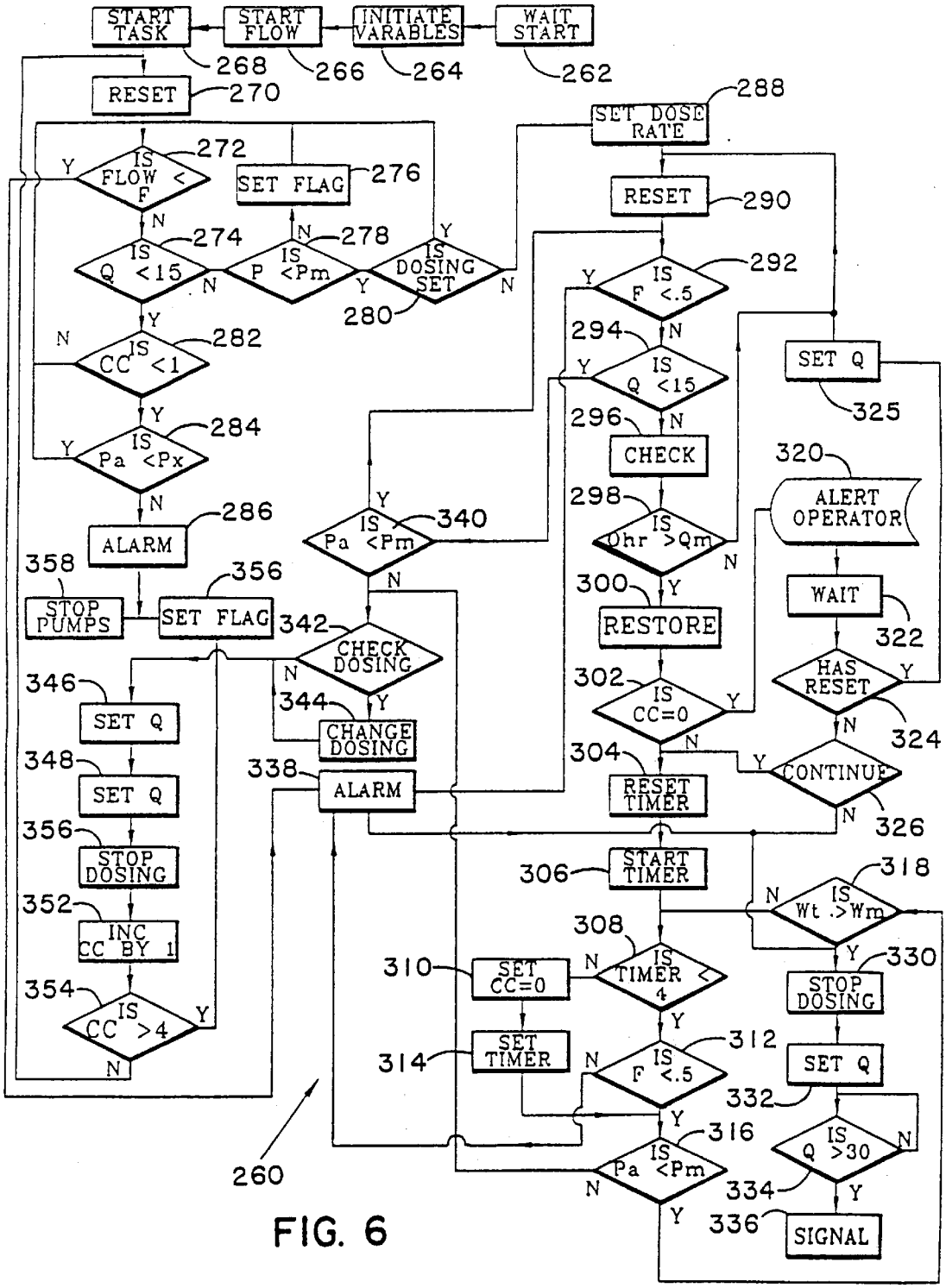
FIG. 6 is a block diagram of suitable logic for controlling the dosage of cellulose according to the present invention.

FIG. 6 depicts the control logic 260 for controlling the powder dosage rate according to the present invention. The main program loop starts at step 262, where the program waits for a start signal. The start signal initializes the program variables at step 264. Flow totalization is initiated at step 266, and a start task signal is initiated by 168. Step 270 ensures that the totalization is set to 0. The comparator 272 determines that the injection water flowrate signal is not less than a selected value, F. Comparator 274 determines that the totalized flow is less than a selected value, e.g., 15 cubic meters, and decision step 282 determines that the cycle count is less than 1. If totalization is more than 15 cubic meters, comparator 278 determines whether the pressure is less than a preselected value and, if not, the flag is set at step 276. If the pressure is greater than the preselected value, step 280 determines if the initial dosing rate has been set. If the dosing rate has not been set, step 288 sets the dosing rate, step 290 sets Qstol to 0, and comparator 292 determines that the flowrate is less than a selected value. Comparator 294 similarly determines if the totalized flow is less than 15 cubic meters. Step 296 checks the dosage rate, and comparator 298 determines if the dosage rate is greater than a selected value. The dosage rate may be restored to a lower value by step 300. Step 302 asks if the cycle count is 0, and if so, an operator is alerted at step 320. Step 322 waits for the operator response. If it is determined that the dosage value results in a lower than preselected maximum pressure, the dosage value is stepped up at step 325 by a selected value, e.g., 0.1% as described subsequently. Step 326 determines whether the operator wishes to continue dosage at the maximum dosage rate. If the decision is to continue the maximum dosage rate, then a timer is reset at step 304. Step 306 starts the timer, and step 308 checks to be sure that the elapsed time is less than 4 hours. If so, the flowrate is checked at step 312 to ensure that the injection flowrate is greater than a selected value, e.g., 0.5 cubic meters per hour. If the injection rate is less than the selected value, an alarm is sounded at 338.

Comparator 316 ensures that the annulus pressure Pa is less than the selected maximum pressure, Pm, and also ensures that the injection tubing pressure Pt is less than its respective preselected value. Assuming both pressures are less than their maximum values, comparator 318 checks whether the total weight of the added dosage powder is less than the set maximum dosage weight. Once all the dosage powder has been added to the mixer 35, dosage is stopped at step 330, and the selected dosage variables are set to 0 at step 332. At step 334, the totalized mixture flow is checked to be sure that it is greater than a selected value, e.g., 30 cubic meters and, if so, step 336 signals that the process is complete. If the elapsed time at step 308 is greater than 4 hours, the cycle counter is set to 0 at step 310, and the time is set to 0 at step 314 and stopped.

At step 340, the injection well annulus pressure and tubing pressures are checked. If the monitor pressures exceed their respective preselected values, the set dosage rate is checked at step 342. Step 344 reduces the dosing rate by a selected value, e.g. 0.1%. At step 346, the minimum dosage rate is set to Qhr, and at step 348 the maximum dosing rate may be set at 1.0%. At step 350, all dosage is stopped. At step 352, the cycle count is incremented, and step 354 checks the cycle count. If the cycle count is greater than 4, the flag is set at step 356 to indicate the abnormal end of dosage, with the pump being stopped at step 358. The pump may also be stopped in response to decision step 284, which checks the pressures Pa and Pt previously discussed. If the pressures are too high, the alarm is activated at step 286, and the pump stopped at step 358.

To reduce the required size of the generator 76 and to minimize stresses on the pumps 45, the pumps are preferably started and stopped in a desired offloading valve sequence, as referred to briefly above. The starting sequence for the pumps 45 is as follows. The computer 88 in the generator control cabinet 73 sends a request to start signal to the motor controls 92 to initiate a pump start signal for one of the two pumps 45. As long as the other of the two pumps is not being started, the offload valve 48 is opened, and the appropriate pump motor is started in a star configuration. After a set period of time which allows the motor to come up to speed, the configuration of the pump motor is switched to delta, and the offload valve 48 is closed to bring the system into operation. To deactivate the pump, a stop signal from the computer 88 causes the offload valve 48 to open, and then the pump motor is shut off. If desired, the activated pump motor may also be shut off after it has been activated for a set period of time. The desired pump injection rate can be achieved by operating the desired pump at the desired motor speed, or by operating both pumps and at a selected one of the two motor speeds.

Figure 7:
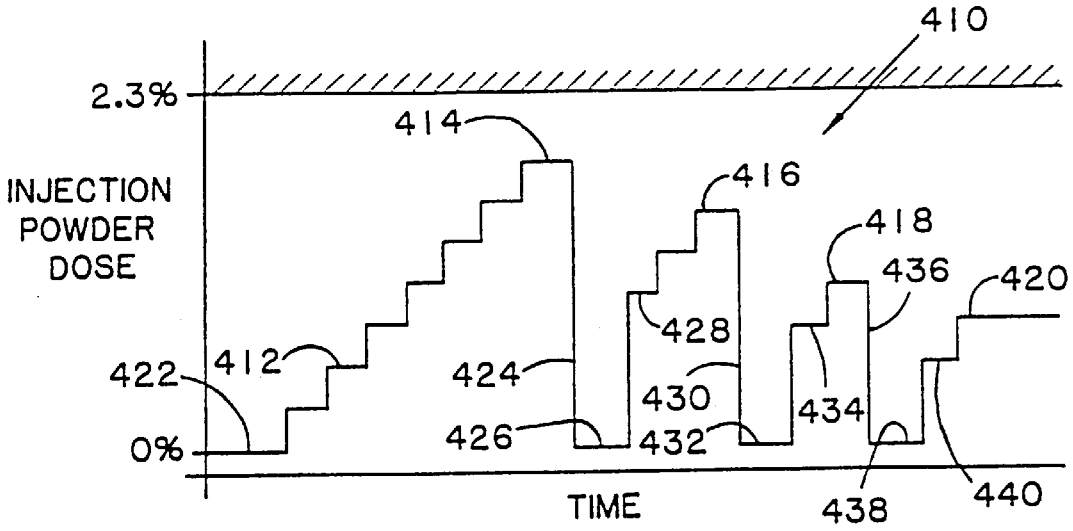
FIG. 7 illustrates a graph of the automatic search for powder dosage rate as a function of time according to this invention.
Figure 8:
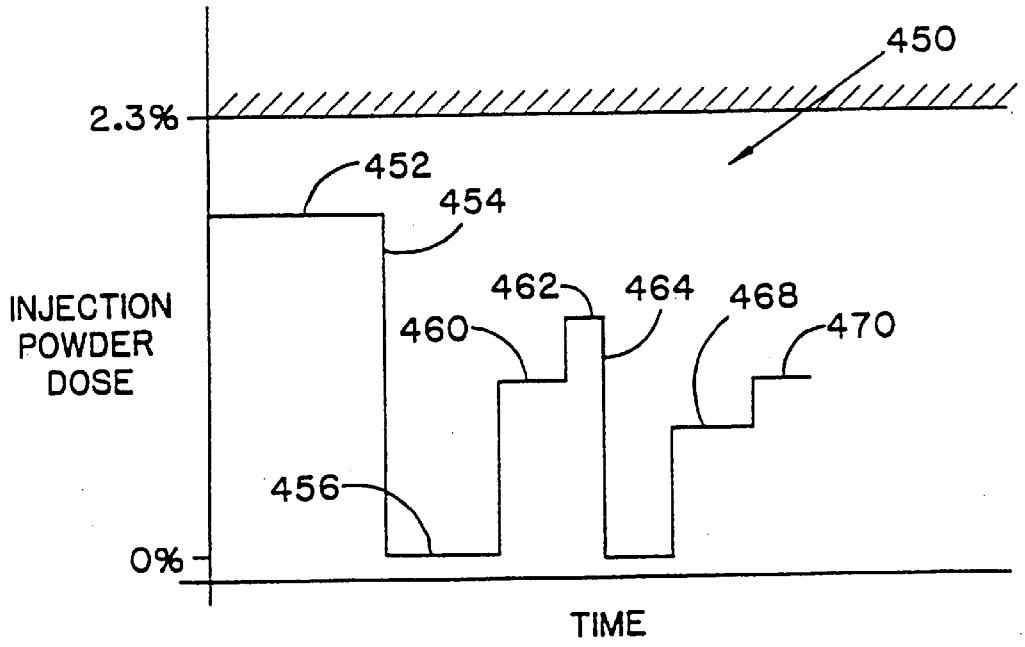
FIG. 8 is an alternative graph of the powder dosage rate as a function of time when a pressure high limit is reached at the well head.

Referring to FIGS. 7 and 8, the software control functionality of the technique according to the present invention is illustrated by injection powder dose v. time graphs. Referring to FIG. 1, it should be understood that the computer 82 receives a well-tubing pressure signal Pt from transmitter 49, and receives a well annulus pressure signal Pa from transmitter 50. The transmitted pressure signal Pa is indicative of the cellulose/water mixture pressure in the vicinity of the formation. A similarly monitored injection water inlet temperature value may be input on computer 84 periodically by the operator. Using the personal computer 84, an operator may input the maximum desired working pressure for the well annulus, the tubing wellhead and the total quantity of cellulose powder to be injected. The computer 82 monitors the signals from the transmitters 49 and 50 and the injection flowrate signal from the flowmeter 44. After a selected quantity of water e.g., 15 cubic meters, has been injected onto the well without any cellulose (represented by line 422 in FIG. 7), cellulose is added to the mixing tank 35 according to a selected sequence.

Referring to FIG. 7, a maximum dosing rate of 2.3% powder to fluid injection water may be set. Powder is initially dosed at a 0.1 percent rate, and assuming that he monitored pressure from the transmitters 49 and 50 have not been exceeded, the dosing rate is increased by 0.1 percent, as shown by the stepped line portion 412 in FIG. 7. If the maximum annulus pressure is reached, the maximum dosage rate should be reduced (see line 414), and the addition of powder is stopped, as shown by line 424. The dosage rate represented by line 414 is entered into computer 82 as the rate Qhr discussed above. A predetermined quantity of water is then injected with no cellulose powder, as evidence by line 426, and dosage is then restarted at a selected level, represented at line 428, with this selected level being between the initial dosing rate and the line 414 dosage rate. The dosing rate again is increased by steps of 0.1% until the maximum dosage rate of Qhr—0.1% (represented by line 416) is reached, or if Pa max is reached again. The input of powder is again stopped, as evidenced by lines 430 and 436, and dosage is subsequently restarted at a rate evidenced by line 434, which is slightly less than the line 416 level. Injection of powder may again be terminated, as evidenced by lines 436 and 438, and dosage restarted at the level evidenced by line 440. The dosage rate is again stepped up to level of line 420, with level of line 420 being less than the level of line 418 by a select amount, e.g., 0.1%. If Pa is less than Pa max, the dosage rate may then be maintained at this level. If Pa max is reached 4 times, dosage is stopped. A quantity of water, e.g., 30 cubic meters of water, is then injected, and an alarm is activated to signal the operator. It may then be possible to restart the pumps at a lower flowrate and try dosage again.

The monitored injection conditions may used to determine how system operation is maintained according to the present invention. Over an extended period of time, the constant dosage rate represented by line 452 in FIG. 8 may result in annulus pressure Pa achieving the maximum value. The dosage rate level represented by line 451 may be substantially equal to the optimum level as derived above. If max pressure Pa is not reached, then this dosage rate may be maintained until the required amount of powder is injected into the wellbore. If the maximum pressure Pa is reached, however, powder input to the mixing tank 35 may again be stopped as evidenced by line 454, and water with no powder injected, as evidenced by line 456. Powder may thereafter be injected at a dosage level represented by line 460, which level may be Qhr divided by 2. The dosage rate may thereafter be stepped up to the level of line 462. If the maximum pressure Pa is again reached, dosing may again be stopped and restarted at the level of line 468, which is less than the line 460 level. If this starting and stopping of the dosage operation occurs more than four times within a preset period of time, all dosage is preferably stopped and an alarm sounded to indicate that operator interaction is desire. If dosage is carried out at a stable Qhr rate for more than four hours without adjustment, the counter is reset. It is possible to try dosing again automatically with a lower flowrate. If Pa is reached, the system may thus search for a new dosage rate four times, as described before.

The control valves 33 and 34 are preferably of the type which automatically (or semiautomatically) control the desired or optimum water injection flowrate to the mixing tanks and thus the injection flowrate to a certain injection well. The control valves 33 and 34 may be conventionally programmed or otherwise controlled to increase the flowrate of water (while simultaneously the flowrate of powder is decreased) if the pressure of the injection well rises above a set value, thereby preventing plugging or the injection well and optimizing the water flooding operation.

Those skilled in the art will appreciate that various powdered water-soluble cellulose ethers may be used for plugging the established flow channels in the formation. A list of suitable cellulose ethers is provided in U.S. Pat. No. 3,848,673 assigned to Phillips Petroleum Company, and includes various carboxyalykl cellulose ethers, hydroxyalkyl ethers, hydroxoyalkyl celluloses, and hydroxypropylmethyl celluloses. The concepts of the present invention may also be applied to other gel forming materials, such as those discussed in U.S. Pat. No. 3,707,191.

Various modifications to the equipment and to the techniques described herein should be apparent from the above description of a preferred embodiment. Although the invention has thus been described in detail for a specific embodiment, it should be understood that this explanation is for illustration, and that the invention is not limited to this embodiment. Alternative equipment and operating techniques will thus be apparent to those skilled in the art in view of this disclosure. Modifications are thus contemplated and may be made without departing from the spirit of the invention, which is defined by the claims.

What is claimed is:

1. A method of controlling the injection of a powder/water mixture through an injection well and into a formation for recovery of hydrocarbons, the method comprising:

(a) determining a desired mixture injection flow rate;

(b) selecting an initial dosage rate of powder;

(c) mixing the selected initial dosage rate of powder and water to form an initial powder/water mixture ratio;

(d) injecting the powder/water mixture through the injection well and into the formation;

(e) monitoring the pressure of the powder/water mixture in the well bore in the vicinity of the formation during step (d);

(f) increasing the selected initial dosage rate of powder to increase the powder/water mixture ratio;

(g) determining a high dosage rate of powder obtained when the monitored pressure reaches a predetermined limit; and (h) thereafter setting the dosing rate between the initial dosing rate and the high dosing rate for injecting the mixture into the formation.

2. The method as defined in claim 1, wherein step (c) further comprises:

automatically regulating the flowrate of water for mixing with the powder.

3. The method as defined in claim 1, further comprising: subsequent to step (h), increasing the dosage rate above the set dosage rate; and resetting the dosage rate at a selected dosing rate functionally related to the monitored pressure.

4. The method as defined in claim 1, further comprising:

monitoring the flowrate of the powder/water mixture injected into the formation; and adjusting the set dosage rate as a function of the monitored flowrate of the mixture.

5. The method as defined in claim 1, wherein step (c) further comprises:

mixing the powder and the water in a mixing chamber having an inert gas chamber above the powder/water mixture; and injecting an inert gas into the inert gas chamber.

6. The method as defined in claim 1, further comprising:

increasing the pressure of the powder/water mixture prior to injection of the mixture into the injection well.

7. The method as defined in claim 1, further comprising:

injecting a selected quantity of water into the injection well prior to performing step (d).

8. The method as defined in claim 1, wherein step (c) further comprises:

mixing the powder and the water in a mixing chamber by inputting water to the mixing chamber tangentially to create a vortex within the mixing chamber; and adding the powder to the mixing chamber adjacent a center of the created vortex.

9. The method as defined in claim 1, wherein step (c) further comprises:

mixing the powder and water in a mixing chamber; and automatically controlling the level of water mixture within the mixing chamber.

10. The method as defined in claim 1, wherein the powder mixed with the water in step (c) is a cellulose material.

11. The method as defined in claim 1, further comprising:

generating electrical power adjacent the injection well for powering equipment to perform steps (b)–(h) inclusive.

12. A system for controlling the injection of a powder/water mixture through an injection well and into a formation for recovery of hydrocarbons, the system comprising:

a mixing tank for mixing a selected initial dosage rate of powder with water to form an initial powder/water mixture ratio;

a pressure sensor for monitoring the pressure of the mixture in the well bore;

fluid control means for maintaining a desired flowrate of the mixture into the injection well;

a flowmeter for monitoring the flowrate of the mixture injected into the injection well; and dosage control means for automatically increasing the selected initial dosing rate of powder at a rate functionally related to the monitored pressure and the monitored flowrate.

13. The system as defined in claim 12, further comprising:

a hopper for storage of cellulose powder;

a conveyor for conveying the cellulose power from the hopper to the mixing tank; and the dosage control means includes a variable speed drive motor for adjusting the speed of the conveyor.

14. The system as defined in claim 13, further comprising:

a portable tanker for housing cellulose powder;

a compressed air source for transporting the cellulose powder from the tanker to the hopper.

15. The system as defined in claim 12, further comprising:

one or more injection pumps for increasing the fluid pressure of the mixture prior to injection into the injection well.

16. The system as defined in claim 12, further comprising:

one or more filters for filtering the water upstream from the mixing tank.

17. The mixture as defined in claim 12, further comprising:

an inert gas source for providing an inert gas blanket within the mixing tank above the powder/water mixture.

18. The system as defined in claim 12, further comprising:

a tank level transmitter for providing an output signal indicative of the mixture level in the mixing tank.

19. The system as defined in claim 18, further comprising:

a controller responsive to the tank level transmitter for automatically controlling the mixture level within the mixing tank.

20. The system as defined in claim 12, further comprising:

a portable generator trailer for transporting one or more electrical generators and a compressed air source.

21. A system for controlling the injection of a powder/water mixture through an injection well and into a formation for recovery of hydrocarbons, the system comprising:

a portable tanker for storage of cellulose powder;

a portable hopper for housing cellulose powder;

a portable compressed air source for transporting the cellulose powder from the tanker to the hopper;

a portable mixing tank for mixing a selected initial dosage rate of powder with water to form an initial powder/water mixture ratio;

a portable conveyor for conveying the cellulose power from the hopper to the mixing tank;

a pressure sensor for monitoring the pressure of the mixture in the well bore;

a flowmeter for monitoring the flowrate of the mixture injected into the injection well; and dosage control means for automatically increasing the selected initial dosing rate of powder at a rare functionally related to the monitored pressure and the monitored flowrate, the control means including means for adjusting the flowrate of cellulose powder along the conveyor.

22. A method of recovering oil from a hydrocarbon field, which method includes delivering a mixture of a gel-forming material and water downhole so that the gel-forming material hydrates to form a viscose gel after deliver, injecting water into one or more injection well, and recovering an oil/water mixture from a production well, characterized by monitoring the back pressure of the gel-forming material and water mixture and varying in response thereto the concentration of the gel-forming material in the mixture to vary the viscosity of the gel downhole.

* * * * *